US006910436B1

(12) United States Patent
Hayman, III

(10) Patent No.: US 6,910,436 B1
(45) Date of Patent: Jun. 28, 2005

(54) PROPULSION STEERED TOWBOAT

(76) Inventor: W. Zack Hayman, III, 1892 Nautilus St., La Jolla, CA (US) 92037

( * ) Notice: Subject to any disclaimer, the term of this patent is extended or adjusted under 35 U.S.C. 154(b) by 0 days.

(21) Appl. No.: 10/839,500

(22) Filed: May 5, 2004

(51) Int. Cl.[7] ..... B63H 25/00
(52) U.S. Cl. ..... 114/246
(58) Field of Search ..... 114/26, 253, 242, 114/246, 248; 440/49

(56) References Cited

U.S. PATENT DOCUMENTS

| | | | | | |
|---|---|---|---|---|---|
| 1,364,961 | A | * | 1/1921 | Thompson | 114/61.19 |
| 3,550,550 | A | * | 12/1970 | Fletcher | 114/248 |
| 3,820,258 | A | * | 6/1974 | Fahrner | 37/317 |
| 3,937,171 | A | * | 2/1976 | Seaborn | 114/246 |
| 4,270,307 | A | * | 6/1981 | Arigaya | 446/154 |
| 5,850,801 | A | * | 12/1998 | Grimmig | 114/242 |

* cited by examiner

*Primary Examiner*—Stephen Avila

(57) ABSTRACT

A conventional style of towboat has been used on U.S. waterways for decades, with steering control reliant on a triad of rudders for each screw, resulting in up to a dozen rudders installed. This propulsion steered towboat relies on an enhanced method of steering with engines to turn towboat, tow, and, an optional pivotal hull slewing under the foredeck and pilothouse. The simple device of horizontally angling fixed propulsion shafting to increase the turning moment available to the propulsion is described, as is the expectation that no measurable propulsion loss is expected for low angles of such horizontal deviation from the standard parallel alignment. If the pivotal hull is included, turning force is greatly increased even at low power settings; it should be possible to top a tow roughly within its own length. Hull position indication is provided with a fixed arm always parallel to the hull, and follow-up type steering is provided with a single steering lever. An unique hull form with simple plating is described to mechanically and hydrodynamically facilitate rapid slewing. The ability of this towboat to so direct thrust without the drag from rudders should substantially reduce the en route power settings required, particularly downstream, and effect a corresponding decrease in fuel consumption.

17 Claims, 8 Drawing Sheets

PROPULSION STEERED TOWBOAT

BACKGROUND OF THE INVENTION

A towboat is "1. Tugboat, 2. a compact shallow-draft boat with a squared bow designed and fitted for pushing tows of barges on inland waterways", according to Merriam-Webster Online. This propulsion steered towboat is a displacement type hull, the descendent of canal boats; whose hull pivots about a vertical axis; with a specific forebody, aftbody and midbody. The simple equipment used on the inland waterways relies on flat bottoms and wide beams for stability, and not on liquid ballast, as river water abruptly and forcibly expands when it cools to 32° F. Towboat usage in the United States extends beyond the inland waterways to the intracoastal waterways, and portions of the Great Lakes and the open Gulf of Mexico.

Two sizes of towboats are in use, line boats and harbor boats. The former have up to four propellers, the latter are usually twin screwed; but a variety of single screw boats have been built. Steering rudders are fitted aft of each propeller, with two flanking rudders forward on each side of the propeller shaft. Thus a triple screw line boat usually has nine rudders; the rarer quadruple screw may have twelve rudders, but some of these boats have used large steering rudders in between propellers and omitted (or removed) the outboard flanking rudders.

This multitude of rudders and propellers is a steady source of income to those in the drydocking and repair business. The waterways traversed seemingly conspire to bend rudders, which, in turn, can disable a propeller. The bank itself, rock jettys and uprooted trees are all capable of bending rudders and cupping propellers. Although many ideas have been tried to allow removing propellers without dropping the steering rudders, removal of the aft rudders remains the norm to access the propellers.

The triple screw line boats have an option to increase steering control in fast currents where higher speed is undesirable. Increasing the forward thrust of the outboard screws increases the effectiveness of the steering rudders; to counter the thrust increase, the center screw is reversed. Control is everything going down a winding river, to avoid bank suction and grounding, which can break the wires holding the barges together. Then an operator has not only the swift current, but also loose and damaged barges to round up. Even worse is the possibility of taking out a bridge pier. In the last decade, several such horrific collisions have occurred, with losses to transiting vehicles, including one passenger train.

U.S. Pat. No. 154 claims "The connecting of canal boats by rule-joints, for the purpose of adapting them to the curvature of the canal, and of steering them by their action on each other, upon the same principle with that by which a rudder is made to steer an ordinary boat." This movement is made manually with a geared tiller against a fixed rack. Another large rudder patent, U.S. Pat. No. 1,364,961, has steerable bows as well as steerable sterns, in a twin hull, with the propulsion between the hulls. It claims "1. A vessel comprising a hull-body provided at its ends with symmetrical, horizontally-swinging steering-sections shaped to form continuations of the hull-body and a diagonally-arranged connection between said sections to cause them to swing . . . "

U.S. Pat. No. 3,937,171 provides twin hulls connected as a parallelogram, thus directing thrust in an arc limited by the hydraulic rams' range within the cross members. It claims "1. A multihull tugboat . . . comprising: two laterally spaced individual hulls; connecting means connecting the hull for relative longitudinal movement . . . shifting means . . . to selectively move the prow of one hull ahead of the other hull; propulsion means on each said hull."

The prior art has attempted to increase steering control, but the complexity introduced, and in some instances, the need for multi-unit standardization, have not resulted in usage. The complications and costliness apparent in the traditional steering system invite improvement with a more robust towboat that will perform reliably under the sometime adverse conditions found on the inland waterways.

SUMMARY OF THE INVENTION

In the first feature of this invention, steering control is achieved without installed rudders by increasing the propulsions' moment arm for course changes when pushing a tow, or operating without a tow. This is done by angling the outboard shafts to where the forward driven end is further apart than the propellers, increasing the turning moment and thus the responsiveness to variations in thrust by the outer shafts. If the propellers are ten feet off the hull's centerline when coupled to a 790' tow, a four degree horizontal shaft angle provides a fourfold increase in the moment arm at the tows pivoting point, producing course changes by varying the speed of the outboard shafts. A reaction loss of a ¼% occurs from the shaft angle, but the convergence of equal thrust streams redirects the streams to dead astern for the "ground" effect, and no measurable propulsion loss is expected for low angles of inclination. The ability to so direct thrust without the drag from rudders should substantially reduce the en route power settings required, particularly downstream, and effect a corresponding decrease in fuel consumption.

In the second feature of this invention, for greater maneuverability, the towboat's waterborne hull is slewable underneath the foredeck and house to direct thrust from side to side. This is done by releasing a brake holding the hull in position to the foredeck and varying the speed of the outboard shafts, again using the horizontal shaft angle to slew the hull rapidly while providing continuous propulsion thrust. If the propellers are 72' aft of the pivot, this same shaft angle in the prior example provides a 50% increase in moment arm at the pivot. Three to five degrees may suffice for line boats, but a larger horizontal shaft angle may be preferable for the more frequently maneuvered harbor boats, or when the horizontal shaft angle is the only steering means employed.

Port and starboard propellers on conventional shafts are driven by engines or motors; a centerline shaft may be fitted on the larger boats. The propellers are managed as to direction and rotational speed by commercially available single lever controls. By varying the speed, or even direction of the outboard shafts, with the horizontal shaft angle the operator more effectively turns the towboat, or turns the tow, or slews the hull to the position desired to direct the tow.

The squared bow, usually attached to a tow, precedes a foredeck structure supporting a pilothouse, with intermediate decks housing crew and gear. Underneath is a hull supporting the foredeck structure, the hull with a fixed vertical mast pivoting within the foredeck structure. The hull slews from action of the propellers, rotating on wheels with radially aligned axles, with provision to brake the hull. Depending on the design, the hull could slew in an arc from the pilothouse's port to starboard, directing the full thrust of the propellers to turn the tow.

Around the mast, in contact with a round well in the foredeck structure, is a rotatable wheel with a pneumatic tire that functions as a circular fender, to absorb any shocks when making up to a tow. Alternatively, the mast could be surrounded by flexible rollers, similar to bearings in a race within the round well. With the precise control that electric propulsion motors provide, and sufficient fendering, even a hard connection may suffice. Any arrangement would include means to prevent the foredeck structure from lifting on the mast. This interior mast also serves as a conduit enclosing control circuits, electrical power and any other utilities for the superstructure. As the hull rotates under the superstructure, flexible hoses and wires would have sufficient vertical height to twist gently.

A third feature of this invention is the simple rotational control to show the hull's position to the operator. In a basic embodiment, the interior mast extends from the hull into the pilothouse, with a fixed arm parallel to the hull's centerline, to show the hull's rotational position. This mast may consist of offset, but rotationally connected segments, to accommodate the superstructure's arrangement and egress of the hoses and wires within.

A steering lever is mounted on a console or other convenient location for steering the towboat. This steering lever is spring loaded to center parallel to the hull's centerline. Mechanical or electronic connections from both lever and mast link to the port propeller's single lever control, with separate links to the starboard propeller's control, altering the relative speed of the controlled propellers as the operator moves the lever off center.

An exemplary mechanical linkage uses two horizontal pulleys, the first mounted around the mast on a steering lever collared to the mast, the second around and attached to the mast. A flexible wire coming off the first pulley wraps around a third pulley and returns to the second pulley. A wire on the other side of the first pulley wraps around a fourth pulley, and returns to the other side of the second pulley. The third and fourth pulleys are spring loaded to stretch the wires and center the lever to the mast and hull; one pulley is linked to the port, the other to the starboard single lever controls. As the operator moves the lever sideways, the attached first pulley rotates, advancing pulley three and its single lever control, while allowing pulley four to retract its single lever control, or reversely. As the hull, and mast, rotate to align with the lever, the second pulley counters the rotation of the first pulley to return pulleys three and four to their original positions.

When free running without a tow, with the hull braked and normally centered, the mast does not rotate. Left steering lever still varies the propellers' speed to steer, but would turn the towboat right. Thus it is desirable that the act of setting the brake reverses the action of the steering lever to maintain the normal relationship; that left lever turns the towboat left. This also applies when pushing a tow with the brake set; that left lever should turn the tow left. Alternatively, the operator may maneuver using the single lever controls, as most do when connecting to a tow or breaking ice.

A fourth feature of this invention is an unique hull form, developed to mechanically and hydrodynamically facilitate stewing. The level forward end of the hull's deck ends in an arc, with a vertical plate around and below this arc. This vertical plate serves as a path for vertical rollers, mounted underneath the foredeck structure. The bow to side transitional arc is a smaller radius to fair into the sides, with the vertical plate wrapping around and continuing aft. A vertical pipe mast is installed at the geometric center of the forward arc. This mast mounts on bottom framing and extends through the deck to at least a height that accommodates the center rotating gear selected, as discussed in paragraph twelve.

The sides of the hull are inclined to travel in multiple directions through the water as the hull slews. This inclination is continued through the side to bow transitions into the bows. The forward bottom plating rises to intersect the inclined bows; the aft bottom plating rises to intersect the propeller tunnel plates. Flat plates intersect the tunnel plates' aft edge to end at the transom bottom. All of the hull's shell plating is either flat, slightly twisted, or curved in only one direction, for simple fabrication.

Lower appendages from the foredeck structure carry inclined rollers that ride against the inclined bows, to prevent the hull from separating from the foredeck structure when the hull is positioned rearward, when the potential for stress is at its greatest. These lower appendages reinforce the center pivot's means to prevent the foredeck structure from lifting. When the hull is slewed beyond the point where one set of inclined rollers no longer bears against the bows, the center pivot's means to prevent the foredeck structure from lifting is employed. In that position, the potential for stress is least as only the beam of the hull works against the pivot.

In a slewed position, half of the vertical and inclined rollers are unloaded and exposed for servicing from a float. These lower appendages also may serve as what is known as the lower towknees; the upper appendages as upper towknees, collectively, as towknees.

DETAILED DESCRIPTION OF THE INVENTION

Figure 1:
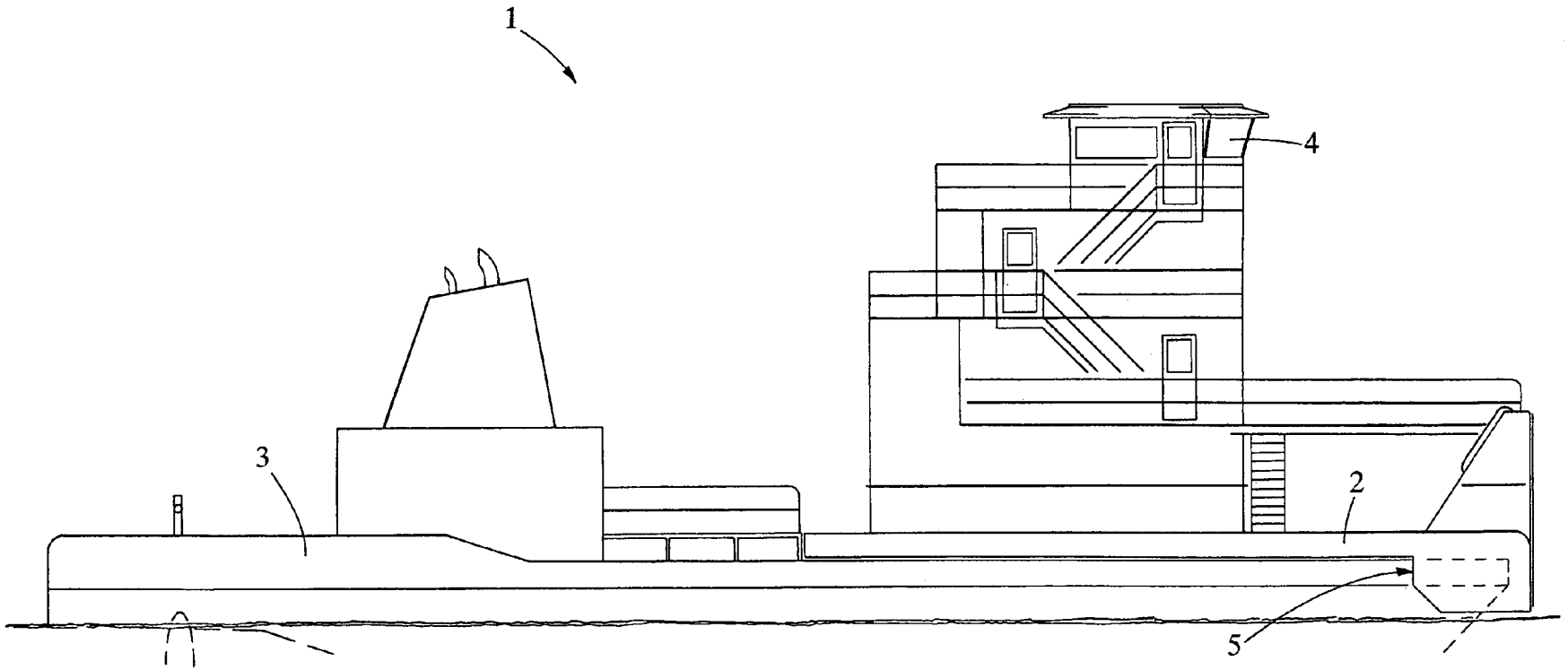
FIG. 1 is a side elevation of an exemplary propulsion steered towboat, with the hull centered and braked.

Referring now to the drawings, FIG. 1 is a starboard side elevation of an exemplary propulsion steered towboat showing the primary components of this tugboat. Reference number 1 is the towboat; 2 is the foredeck structure, 3 is a 100' hull and 4 is the pilothouse. Also shown is the edge of the hull swing stop, 5. The nose of the hull, encased in the lower foredeck structure, is indicated by hidden lines. This profile is quiet similar to most shallow draft towboats, except for the absence of deck mounted steering gear, and rudders.

Figure 2:
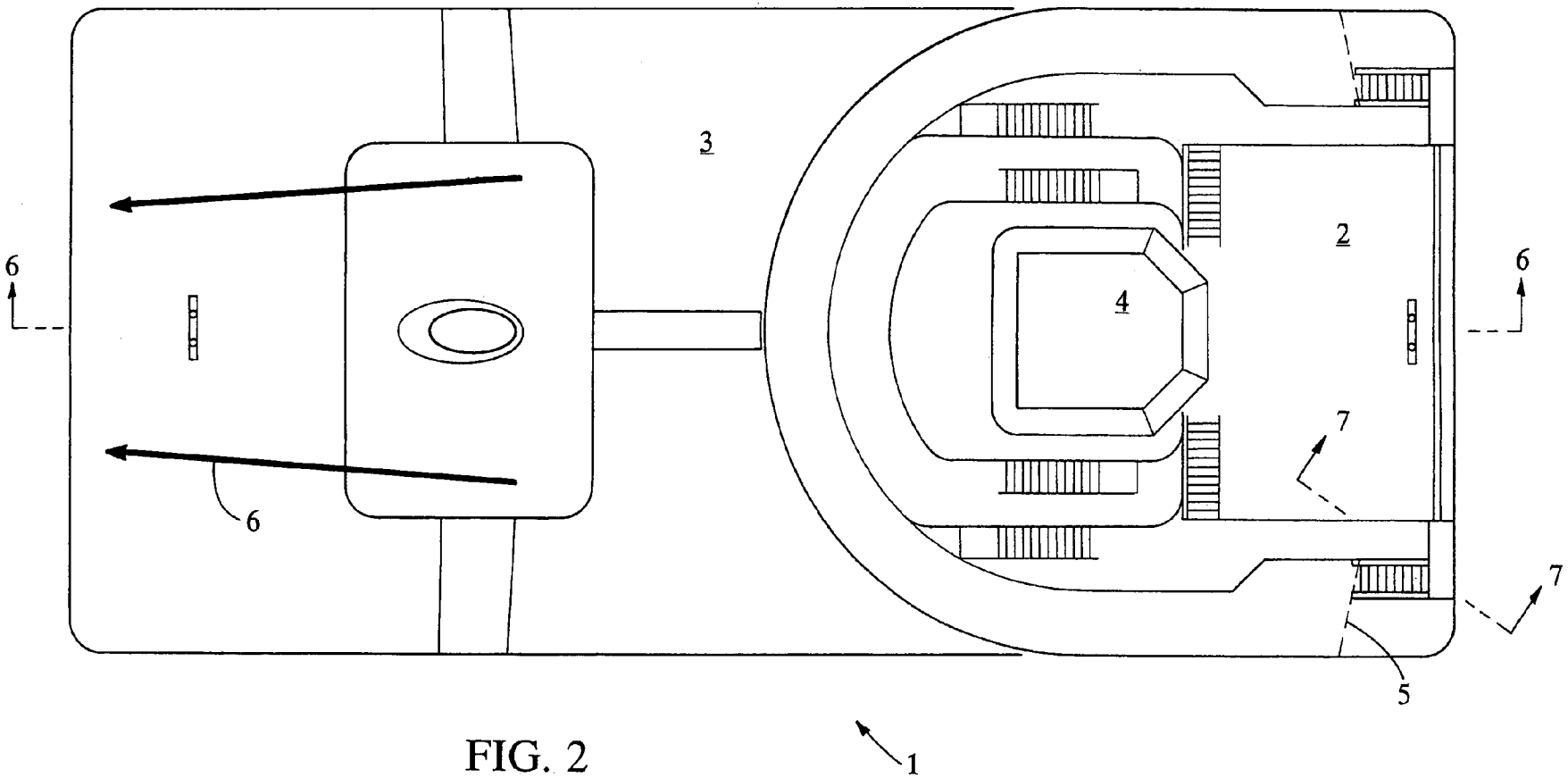
FIG. 2 is a plan view of FIG. 1.

FIG. 2 is a plan view of FIG. 1 showing that the aft end of the foredeck structure 2, is a semi-circle to minimize any hazard to personnel when the hull is slewing. This end could also be a half hexagon, or even squared off, if an alarm bell were used to warn the crew of impending motion. A bell could be activated by movement of the steering lever when the hull is not braked. The line of the hull slewing stop 5 on the underside of the foredeck structure is indicated by a dotted line. The horizontally angled shafts and propellers are represented by lines of thrust 6. Again, steering gear and rudders are absent; with a small horizontal shaft angle, or none at all, rudders will be needed to slew the hull within a time limit acceptable to an operator. If the hull is not built as slewable, and the angled lines of thrust are the primary steering means, one or more rudders may increase effectiveness, even if mounted between the propellers. Additionally or supplementally, side trusters could be installed, if previous debris clogging problems can be resolved. Two sections are shown which are FIGS. 6 & 7.

Figure 3A:
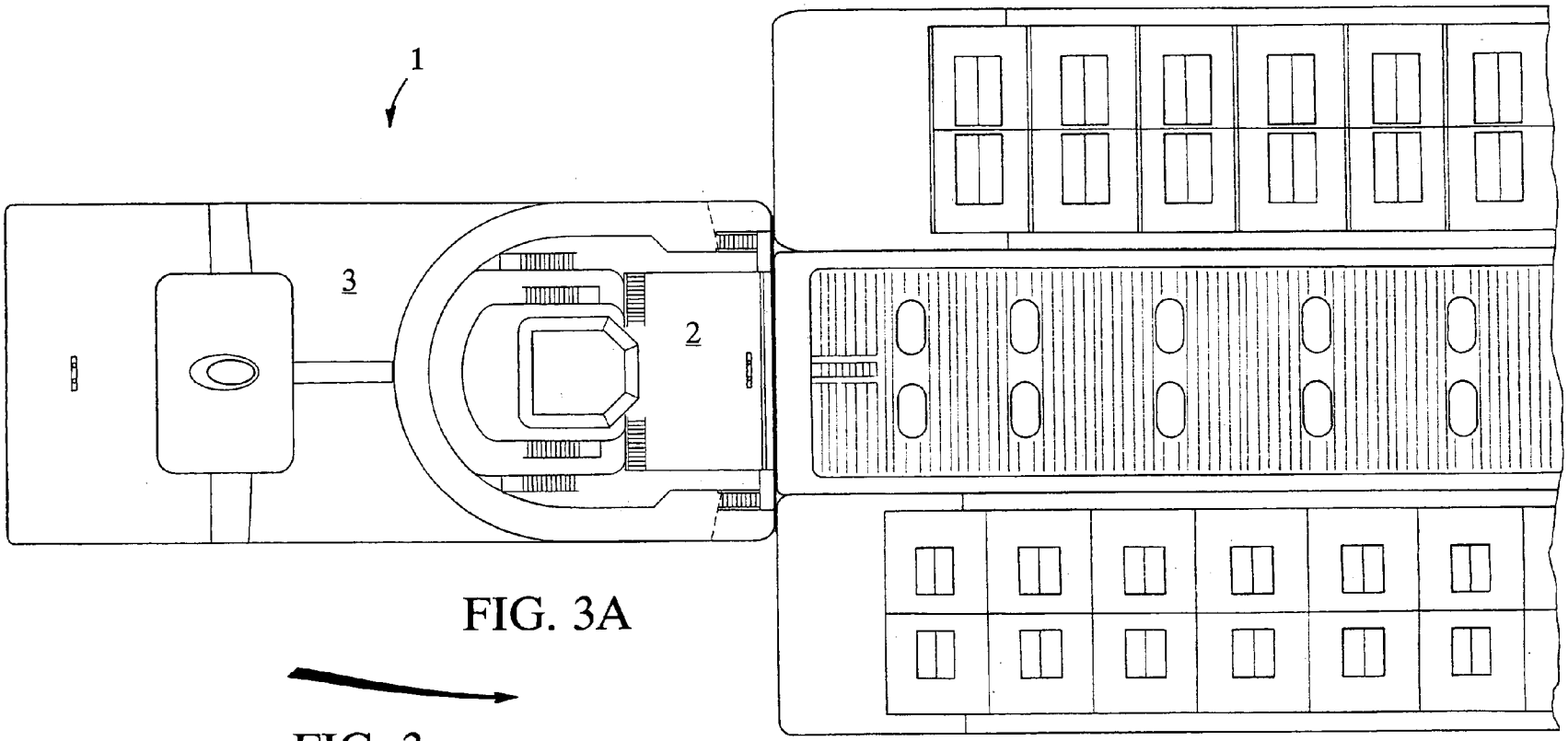
FIG. 3A is an enlarged view of the towboat and aft barges' stern.
Figure 3:
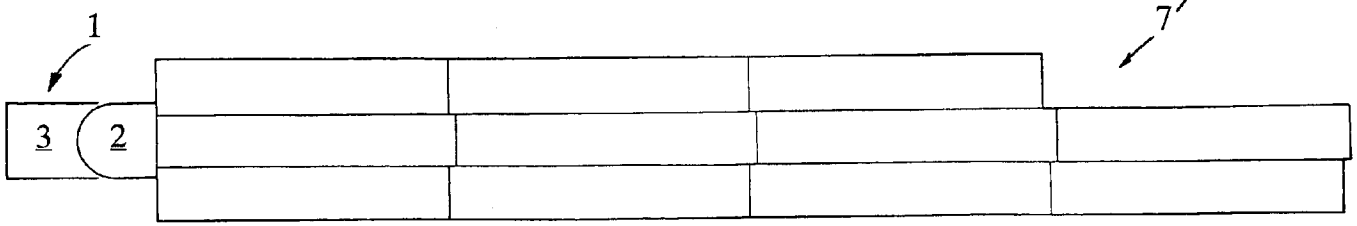
FIG. 3 is a plan view of this towboat pushing twelve barges with the hull centered and braked.

FIGS. 3 and 3A show the towboat with the hull centered and braked pushing a tow 7, with unequal forward thrust pivoting the tow to the left. As the pivot point is about one barge length from the front, the towboat is moving both forward and to the right. The tow represented is typical of the upper Mississippi River and is sized to fit through standard 110' wide and 1000' long locks. As represented, the barge string is 795' long.

Figure 4A:
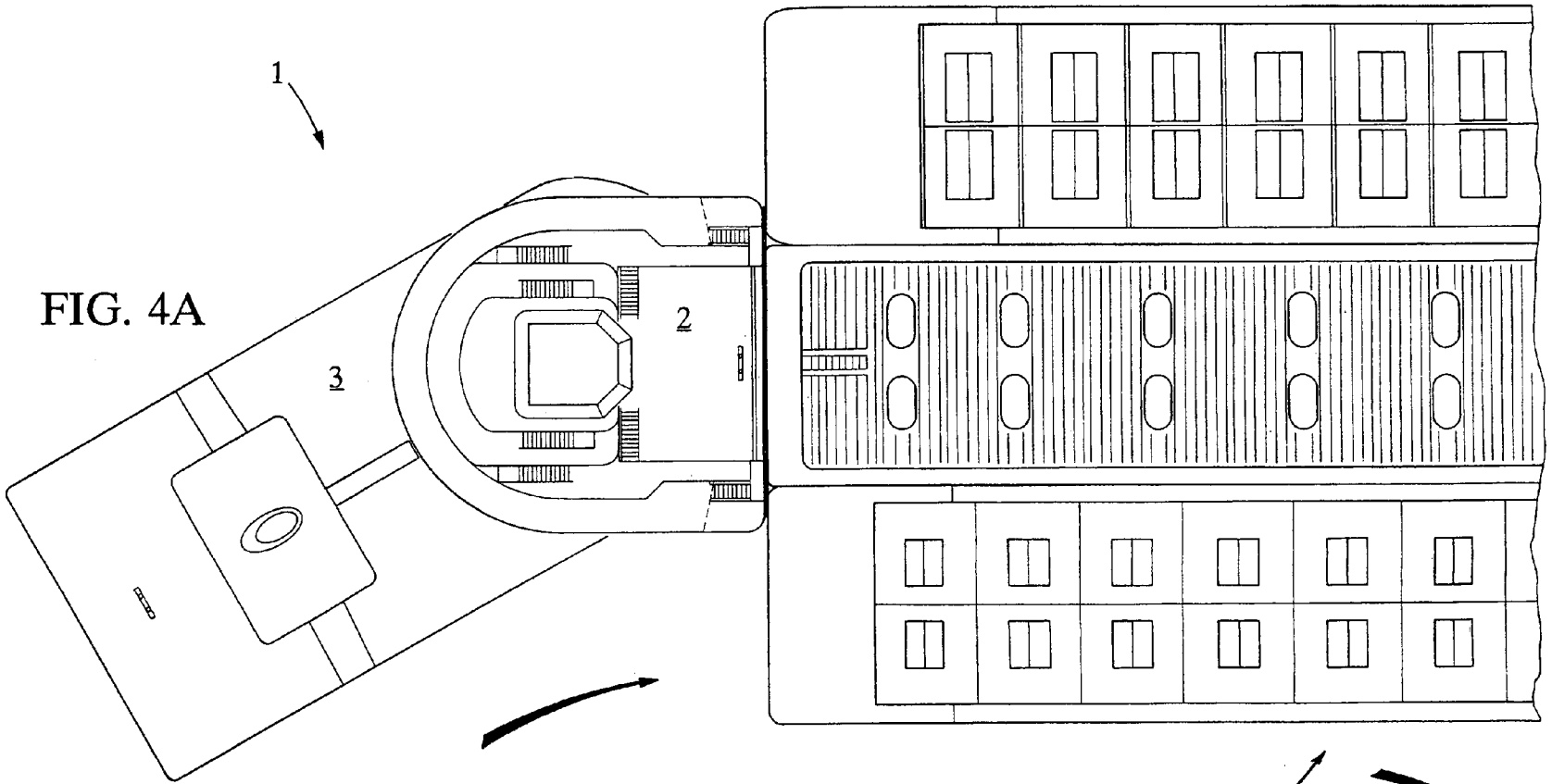
FIG. 4A is an enlarged view of the slewed towboat and aft barges' stern.
Figure 4:
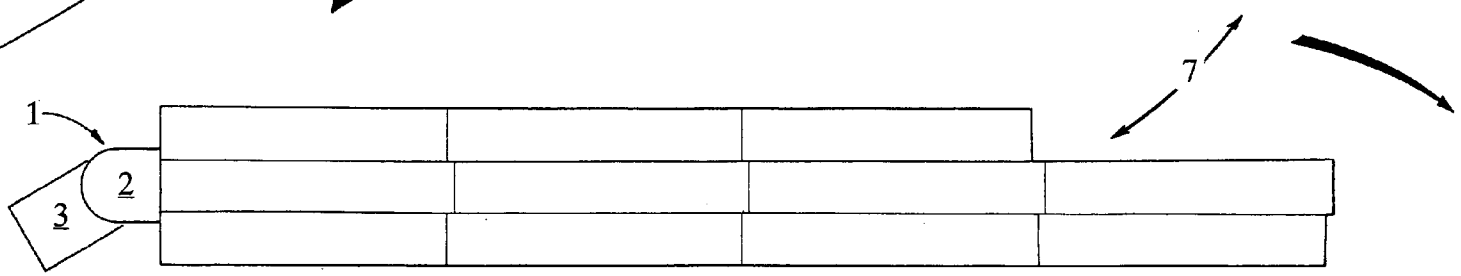
FIG. 4 is a plan view of this towboat with the hull slewed 30°, pushing the barges to the right.

FIGS. 4 and 4A shows the hull slewed at about thirty degrees to accomplish a sharp turn to the right. With this propulsion angle, the pivot point moves back to about one and a half barges from the front of the tow 7. To allow this slewing, the captain, or his relief, the pilot, has remotely released a brake or brakes locking the hull 3, to the foredeck structure 2. Several braking arrangements are possible, such as devices following the aft curve of the foredeck structure: a horizontal wheel with brake riding the curve; a brake caliper riding a horizontal flat bar attached to the curvature, or a brake acting directly on the curvature. The numerous wheels and rollers could have brakes, if such brakes were sufficiently accessible if the brake release failed. The foredeck structure could contain a device acting directly on the hull deck, or reversely.

Figure 5:
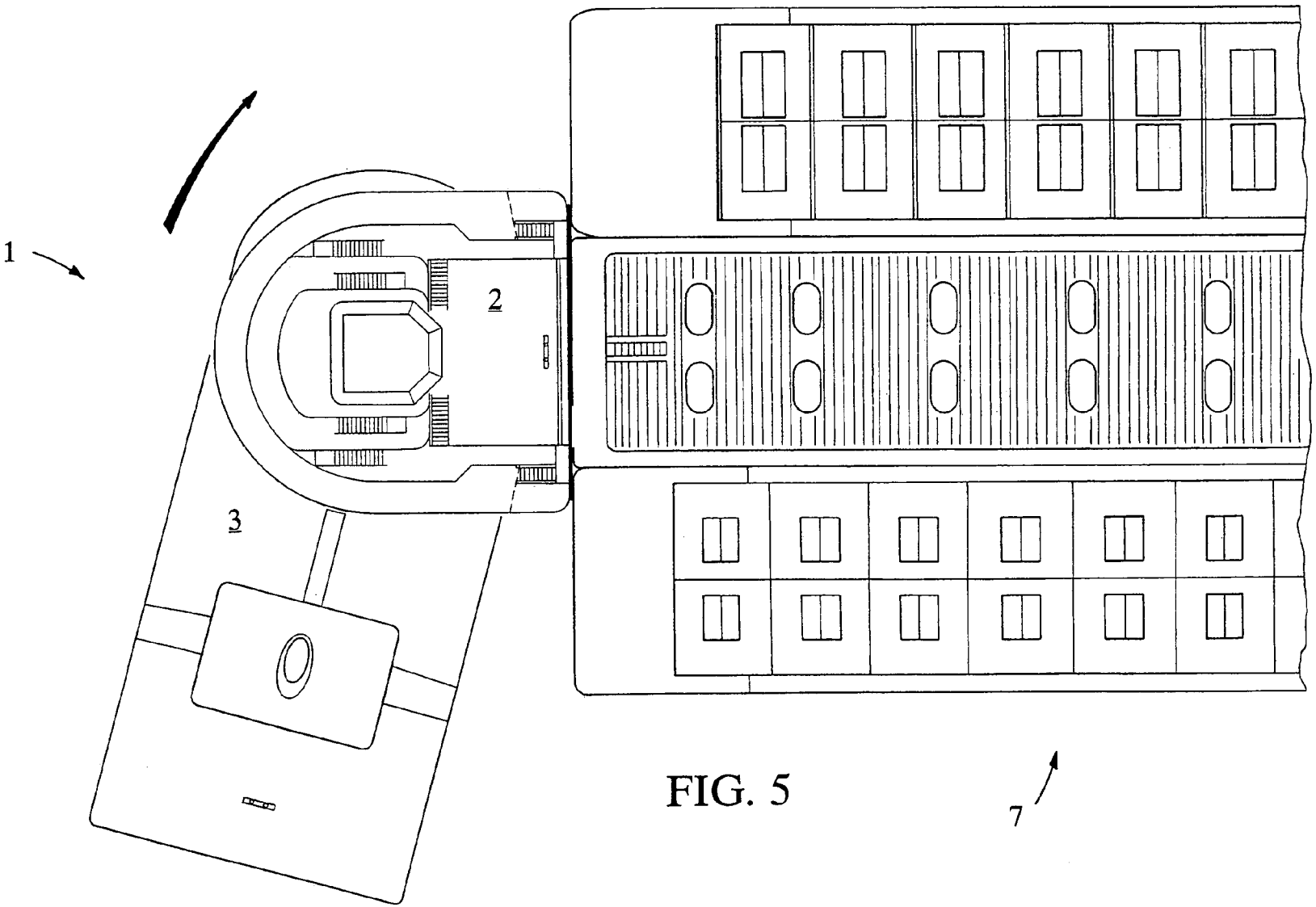
FIG. 5 is a plan view of this towboat with the hull slewed 75°, turning the tow around from downstream to upstream.

FIG. 5 shows the hull 3, slewed to about seventy-five degrees, to "top" the tow from downstream to upstream. Turning the tow upstream is sometime necessary in a strong current to stop the tows movement over the ground, or to tie off to a wharf. With this sharp propulsion angle, the pivot point has moved to about the middle of the tow, allowing the tow to turn in approximately its own length.

Figure 6:
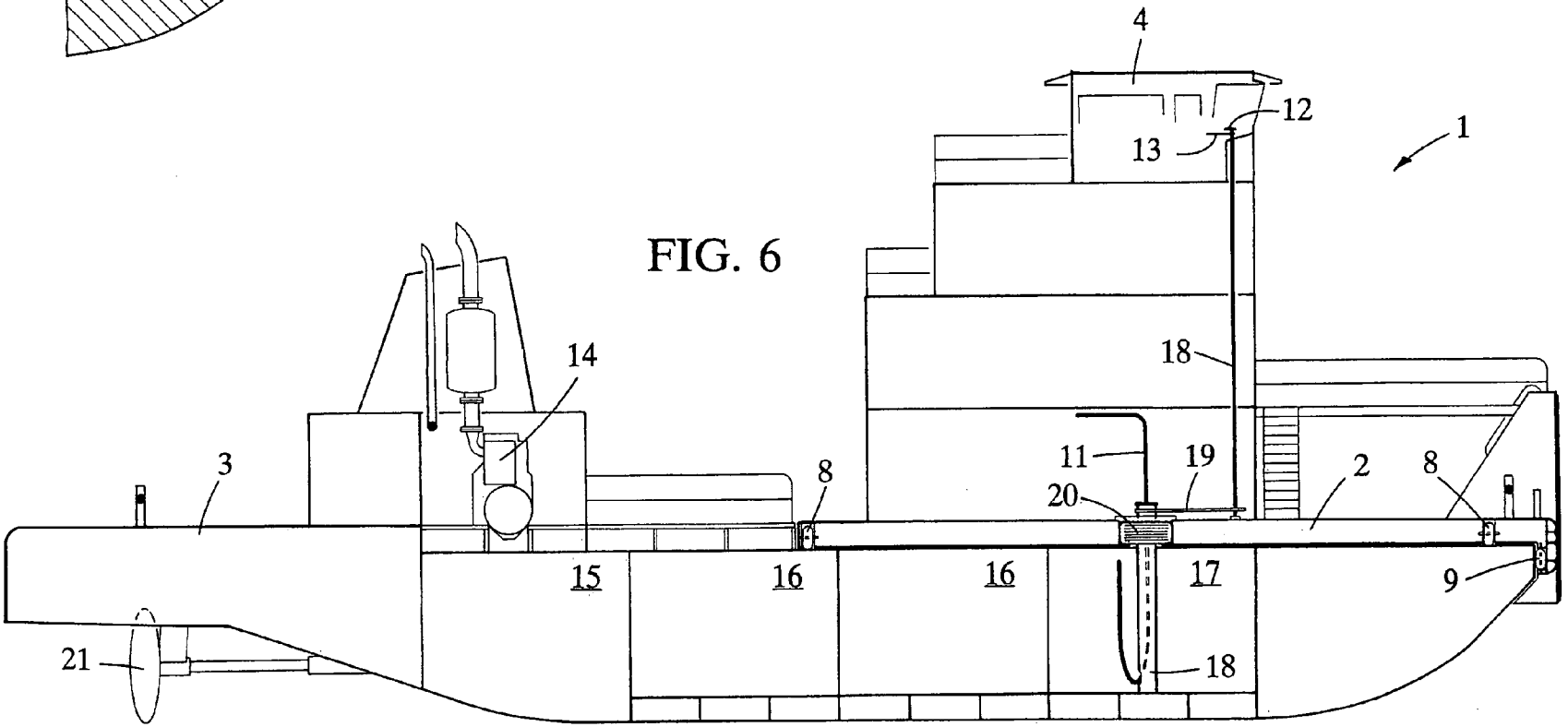
FIG. 6 is an exemplary centerline section of this towboat.
Figure 8:
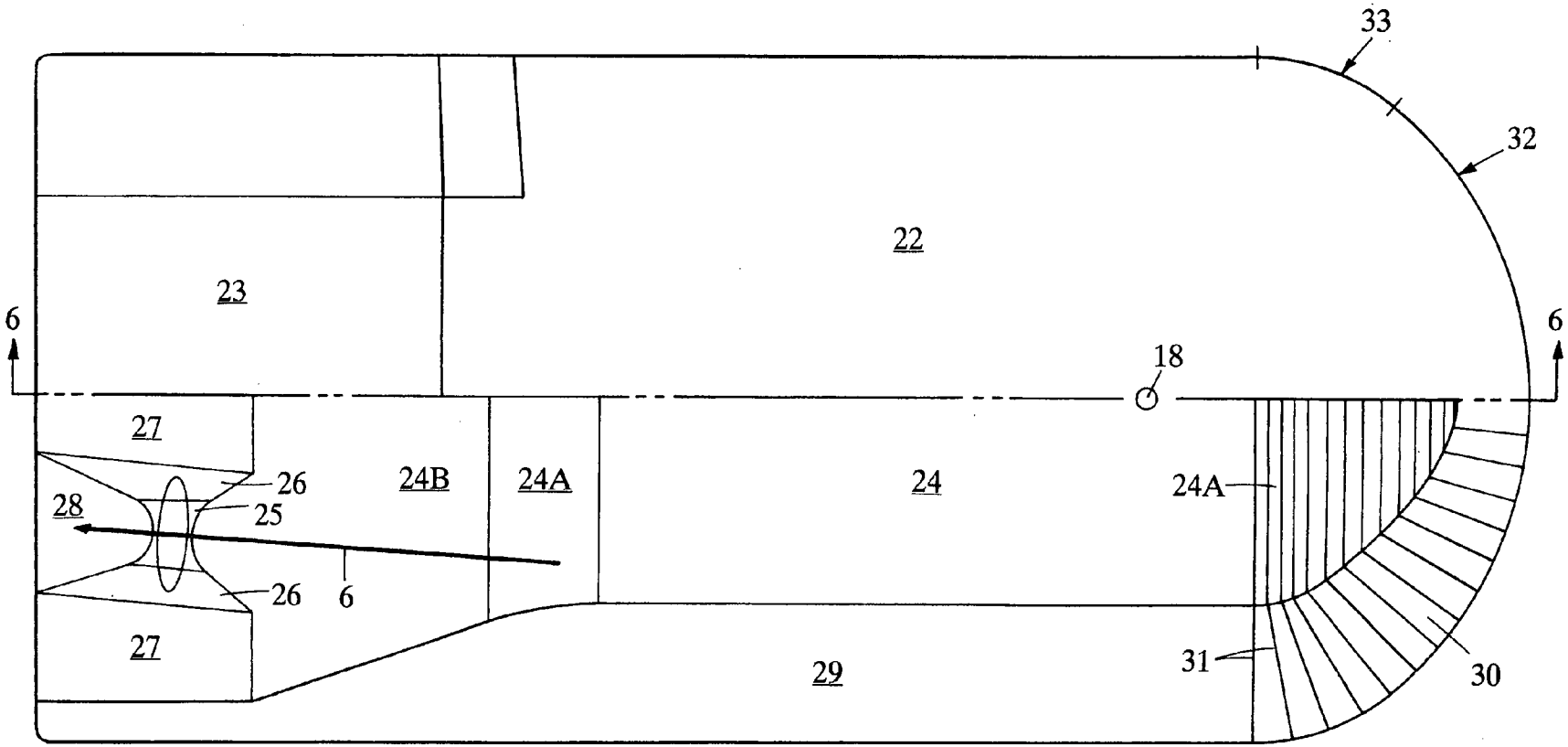
FIG. 8 is a plan view of the this towboat's exemplary hull form, the starboard side showing the bows, side and bottom, the port side the deck.

FIG. 6 shows the centerline section indicated in FIGS. 2 and 8. Two support wheels, 8, are part of one or more rings of wheels supporting the foredeck structure, 2. Other more exotic means of supporting the foredeck structure would include railroad type magnetic levitation gear, or opposed permanent magnets. A roller or wheel 9, is one of many riding the bow arc discussed in paragraph 17. A cable and hose bundle 11, passes through a lower mast 18, connecting the slewable hull to the foredeck structure and pilothouse. A fixed arm 12, attached to an upper mast 18, reliably shows the position of the hull to the operator, as discussed in paragraph 13. The hull position can also be shown electronically with synchros. The steering lever 13, is shown pivotally centered on the mast, and thus the hull, as discussed in paragraphs 14 and 15. The described system can also be mimicked electronically with the operator carrying a remote.

A main generator 14, is shown mounted transversely; 15 indicates a motor room, both assuming electrically driven propulsion is used. 16 indicates midships fuel tanks made possible by the compactness of electric drive, a position that minimizes the trim effect of the fuel load. 17 indicates an auxiliary machinery space with the lower mast and the end of the cable and hose bundle. A link 19, connects two mast segments. 20 is the rotatable wheel discussed in paragraph 12. 21 is an indication of the port propeller.

Figure 7:
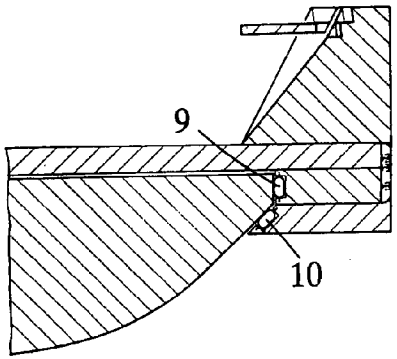
FIG. 7 is a radial section showing vertical rollers behind the squared bow and inclined rollers under the towknees, both bearing on the hull.

FIG. 7 is the radial section indicated in FIG. 2 showing an inclined roller or wheel bearing against the sloping bow plating below a vertical roller 9. The inclined rollers are positioned where either the port or the starboard set is always in contact with the hull, albeit, off center, to reenforce the center pivots means to keep the foredeck structure in position. A center set may provide additional strength in some circumstances.

FIG. 8 shows an exemplary combined lines and plating plan, the lower half the bottom and side; the upper half the main deck level. A line of thrust 6, represents the angled propulsion shaft. The mast 18, is shown at the center point of the bow arc 32; the transition arc 33 smoothly connects to the sides. Main deck 22, raised aft deck 23 and other unnamed standard plating show the simple deck arrangement. Bottom flat plating 24 curves up at both ends, 24A, and continues aft as sloping flat plating 24B. Rolled tunnel plate 25 intersects both 24B and flat exit plate 28, as does the slightly twisted side tunnel plate 26. Flat aft plates 27 connect to sloping side plating 29, connecting forward to similarly inclined curved bow plates 30. Form lines 31 at ten degree intervals radiate from both the center of the transition arc, and the bow arc's and mast's common center and extend transversely to the port form lines.

Figure 9:
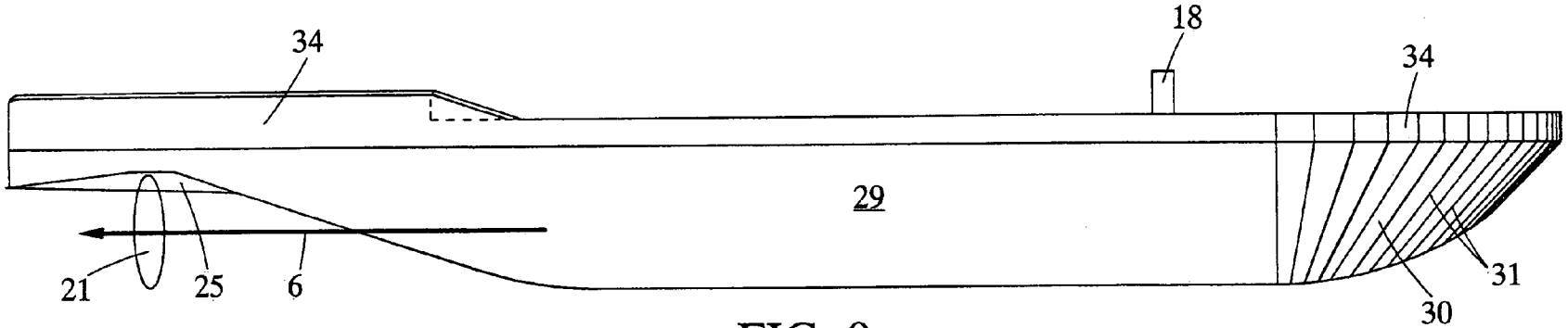
FIG. 9 is a side view of this hull form and mast.
Figure 10:
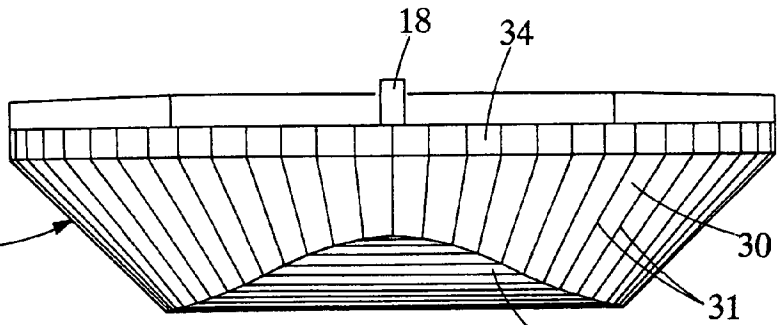
FIG. 10 is a bow view of this hull form, including the center mast and raised aft deck.
Figure 11:
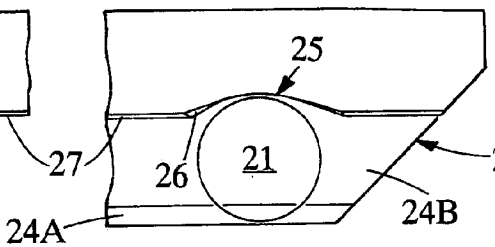
FIG. 11 is a half-section of this hull form, at the starboard propeller looking forward.
Figure 12:
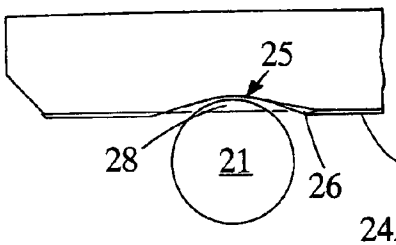
FIG. 12 is a half-section of this hull form, at the starboard propeller looking aft.

FIG. 9 is a side view of FIG. 8 showing many of the same components, reference characters 6, 18, 25, 29–31, plus the propeller 21 and vertical plate 34, as discussed in paragraph 17. Radial form lines 31 extend up in way of vertical plate 34. FIG. 10 is the bow view showing the mast 18, intersection of the bottom 24A and bows 30 plating, as well as the bows to vertical plate 34. Radial form lines 31 from the sloping side 29 extend transversely in way of the bottom plate 24A, and vertically in way of plate 34. FIG. 11 shows a section at the starboard propeller looking forward, while FIG. 12 looks aft. The only plating requiring forming by rolling is the propeller tunnel plates 25; the remaining curved plating, such as 24A, will drape in place. The other referenced plating is flat. This contrasts with the practice of forging some of the more convoluted plating used in the past.

What is claimed is:

1. A towboat capable of both free running and propelling tows on navigable rivers and other waterways, comprising:

at least two fixed propulsion shafts set at a horizontal angle, driven at one end with attached screw propellers at the other, said propellers capable of producing thrust and reversely, said propellers independently managed by single lever controls, said thrust said propelling means for said towboat and tow, said shafts' horizontal angle increasing the turning moment and responsiveness of said towboat when varying said thrust; and increasing the turning moment and responsiveness of said propelled tow when varying said thrust.

2. The towboat of claim 1, where said shafts' horizontal angle and variable thrust is the only means of steering said towboat and tow.

3. The towboat of claim 1, where said shafts' horizontal angle and variable thrust is augmented by mechanical means of steering said towboat and tow.

4. A towboat capable of both free running and propelling tows on navigable rivers and other waterways, comprising:

a foredeck structure aft of a barge attaching frontal face including upper and lower appendages, said foredeck structure supporting thereon a pilothouse, a hull pivotally attached and supporting said foredeck structure; and said hull slewable in an arc around to either side.

5. The towboat of claim 4, said hull further comprising:

at least two fixed propulsion shafts set at a horizontal angle, driven at one end with attached screw propellers at the other, said propellers capable of producing thrust and reversely, said propellers independently managed by single lever controls, said thrust said propelling means for said towboat and tow, said shafts' horizontal angle increasing the turning moment at said hull's pivotal attachment when varying said thrust to rapidly slew said hull under said foredeck structure, to direct said thrust to any point in said arc; or to direct said thrust to any point in said arc reversely.

6. The towboat of claim 5, where said shafts' horizontal angle and variable thrust is the only means of slewing said hull under said foredeck structure.

7. The towboat of claim 5, where said shafts' horizontal angle and variable thrust is augmented by mechanical means of slewing said hull under said foredeck structure.

8. A towboat capable of both free running and propelling tows on navigable rivers and other waterways, comprising:

a foredeck structure supporting thereon a pilothouse, a hull pivotally attached and supporting said foredeck structure, propellers capable of producing thrust and reversely, said propellers independently managed by single lever controls, said thrust said propelling means for said towboat and tow; and an interior mast attached at said hull's pivot extending upwards into said pilothouse.

9. The towboat of claim 8, where said mast has one or more mechanically linked offset segments extending to said pilothouse.

10. The towboat of claim 8, where said mast has a fixed arm attached indicating the position of said pivotal hull.

11. The towboat of claim 8, where said mast communicates with a steering lever centered to said pivotal hull.

12. The towboat of claim 11, where said steering lever is adopted through said single lever controls to regulate said thrust of said propellers, wherein side pressure on said steering lever varies said thrust of said independently managed propellers to slew said hull.

13. A towboat capable of both free running and propelling tows on navigable rivers and other waterways, comprising:

a foredeck structure aft of a barge attaching frontal face including upper and lower appendages, a hull pivotally attached and supporting said foredeck structure, at least two fixed propulsion shafts set at a horizontal angle, said hull formed to mechanically and hydrodynamically facilitate rapid slewing.

14. The towboat of claim 13, with said hull form incorporating an arc at the forward end of a level deck and a mast at the center point of said arc.

15. The towboat of claim 13, said hull form incorporating inclined sides, bows and bottom to facilitate multi-directional movement through the water.

16. The towboat of claim 15, wherein said sides, bows and bottom are covered with flat plating; or with plating curved in only one direction.

17. The towboat of claim 13, wherein said lower appendage by bearing means against said inclined bows, adapted to prevent said hull from separating from said foredeck structure.

* * * * *